United States Patent [19]

Wüthrich et al.

[11] Patent Number: 4,568,924

[45] Date of Patent: Feb. 4, 1986

[54] METHOD OF AND APPARATUS FOR SIGNALLING AN ALARM

[75] Inventors: Alfred Wüthrich, Zü; Jürg Muggli, Männedorf; Andreas Scheidweiler, Jona, all of Switzerland

[73] Assignee: Cerberus AG, Männedorf, Switzerland

[21] Appl. No.: 660,076

[22] Filed: Oct. 12, 1984

[30] Foreign Application Priority Data

Oct. 17, 1983 [CH] Switzerland ..... 5633/83

[51] Int. Cl.[4] ..... G08B 17/00; G08B 29/00

[52] U.S. Cl. ..... 340/587; 340/529; 340/584; 340/628

[58] Field of Search ..... 340/587, 584, 628, 529, 340/530; 169/16, 60, 61, 23

[56] References Cited

U.S. PATENT DOCUMENTS

| | | | |
|---|---|---|---|
| 3,599,195 | 8/1971 | Boyko | 340/587 |
| 3,934,145 | 1/1976 | Dobrzanski et al. | 250/381 |
| 4,151,522 | 4/1979 | Yamauchi | 340/587 |

FOREIGN PATENT DOCUMENTS

| | | |
|---|---|---|
| 2051649 | 12/1971 | Fed. Rep. of Germany . |
| 2732571 | 2/1979 | Fed. Rep. of Germany . |
| 2816192 | 10/1979 | Fed. Rep. of Germany . |
| 623154 | 5/1981 | Switzerland . |

OTHER PUBLICATIONS

Ruggli et al., "Cerberus Alarm-Konzeption".

*Primary Examiner*—Glen R. Swann, III

*Attorney, Agent, or Firm*—Werner W. Kleeman

[57] ABSTRACT

In the apparatus for signalling an alarm, for example, in a gas or fire detecting installation, a detector is reset after a first response and the time duration until the next-following detector response is determined and classified with respect to three classes of time periods. When the time duration until the further detector response is beyond a predetermined upper or outer time limit, no alarm signal is released and the apparatus returns into its original state. When the further detector response occurs between two time limits, the alarm is immediately signalled. When the further detector response occurs prior to a lower one of the two time limits, there is carried out still one further test during which the detector is once again reset. The alarm signal will only be released if an additional further detector response is still observed prior to the upper time limit. In this manner the reliability of alarm signalling can be enhanced and the frequency of the occurrence of false alarms, particularly due to the occurrence of short-time or brief spurious conditions, can be significantly reduced.

18 Claims, 3 Drawing Figures

METHOD OF AND APPARATUS FOR SIGNALLING AN ALARM

BACKGROUND OF THE INVENTION

The present invention relates to a new and improved method of, and apparatus for, signalling an alarm.

In its more particular aspects, the present invention relates specifically to a new and improved method of, and apparatus for, signalling an alarm in which, after a first response of a detector connected to a central signal station, the detector is reset for a first time. At a predetermined moment of time after the first detector response there are started in the central signal station two test time periods of predetermined different time durations and an alarm signal is only transmitted after the occurrence of at least one further response of the detector. An alarm signal is then transmitted if the detector responds a second time after the expiration of the test time period of comparatively shorter duration and prior to the expiration of the test time period of comparatively longer duration.

Such methods and apparatus are suited for signalling various dangerous states or conditions by means of appropriate detectors which respond to the relevant state or condition. An important application is, for example, the signalling of a fire break-out by means of fire detectors which respond to phenomena due to the existence of combustion or burning conditions like, for example, smoke, aerosols formed during a fire, gases formed during a fire, radiation of flames, temperature variations, and so forth or the signaling of the presence of combustible and/or toxic gases.

Fire detecting installations, on the one hand, are intended to signal a fire at an incipient stage and to release or initiate appropriate fire fighting measures. It is required for such purpose to employ highly sensitive automatic fire detectors which already react to phenomena occurring in the early stage of a fire. Such type of early response detectors are, for example, ionization smoke detectors or optical smoke detectors. However, when such fire detectors are operated at their highest possible sensitivity, there exists the danger that an alarm signal is released or triggered by interfering or spurious factors even if no dangerous state or condition, i.e. a fire, is present and that, due to such faulty or deceptive alarm, complicated fire fighting measures are unnecessarily initiated like, for example, the mobilization of the fire brigade or the setting into operation of a fire-extinguishing installation.

During use of the method and the apparatus of the initially mentioned type as known, for example, from German Pat. No. 2,051,649, certain faulty or spurious alarms due to short-time interferences or noise, such as, for instance, clouds of cigarette smoke or transient electrical faults can already be prevented by automatically resetting a fire detector after its response and observing the next following response. In this way spurious effects causing unwanted false alarms can be differentiated from more persistent actual fire states or conditions. In order to reliably eliminate and distinguish such faults, there is required, however, a multiple repetition of the resetting and re-activating cycles. During such repetitions there is, however, the danger that occasionally an actual fire is not or only belatedly detected and signalled and this, of course, is extremely undesirable in practice. The suggestion to remedy such situation by statistically evaluating the further response signals is not a satisfactory proposal because statistical methods can not comply with the reliability requirements of fire detecting installations. It is of further disadvantage in such known installations that fire detectors of various types, for example, fire detectors displaying rapid response, fire detectors displaying slow response, fire detectors with or without integration circuitry, cannot be connected in common to the same evaluation circuit.

A different approach has been adopted by the known methods of signalling an alarm as disclosed, for example, in Swiss Pat. No. 623,154 or in the Cerberus brochure FP 198 of the assignee of this application, as authored by M. Ruggli and F. Dätwyler, entitled "Cerberus Alarm-Konzeption", wherein humans are intergrated into the decision-making process. Accordingly, an alarm signal triggered or released after one or multiple repetitive responses of a fire detector is only transmitted when no controlling personnel is present, when the signal is not acknowledged or receipted within a predetermined control time period and additionally when no message or information concerning the actual state or condition of danger is received within a reconnaissance time period of comparatively longer duration from a dispatched reconnaissance party.

It is, however, a disadvantage of this state-of-the-art technique that such method is dependent on human shortcomings, that is due to negligence and inattentiveness of the control personnel or due to faulty assessment of a dangerous situation, the alarm signal may fail to be triggered or released or may be belatedly initiated with partially catastrophic consequences.

In the prior art method of differentiating between a persistent false alarm due to a defective detector and an actual false alarm, for example, as disclosed in German Patent Publication No. 2,816,192, there have been suggested means for use with a fire detecting installation. Such means interrupt the detector voltage after the first alarm signal at least once for an adjustable period of time and indicate, as a spurious signal, an alarm signal which is immediately present when the detector operating voltage is again turned on. Such means transmit, as actual alarm signals, alarm signals which arrive at a certain delay. The therein described central fire detecting station thus is designed such that a permanent response of a detector due to a defect is not further transmitted as an alarm and only secondarily so that there can be suppressed deceptive alarms due to brief spurious effects. In such central fire detecting station, signals originating from all detectors, particularly from those with and without time-delayed response, are processed in the same manner.

SUMMARY OF THE INVENTION

Therefore, with the foregoing in mind, it is a primary object of the present invention to provide a new and improved method of, and apparatus for, reliably signalling an alarm in a manner which is not afflicted with the aforementioned drawbacks and limitations of the prior art heretofore discussed.

Another and more specific object of the present invention is directed to the provision of a new and improved method of, and apparatus for, signalling an alarm in which the reliability of alarm signalling is improved and faulty or deceptive alarms are avoided to the greatest possible extent.

Still a further significant object of the present invention is directed to a new and improved method of, and apparatus for, reliably signalling an alarm in a manner such that deceptive alarms are positively and effectively suppressed.

Another, still important object of the present invention is directed to a new and improved method of, and apparatus for, signalling an alarm in which deceptive or spurious alarms are reliably suppressed and in which, during signal processing at the central signal station, the differences in the characteristic response of detectors with and without time delay are taken into account and compensated, so that such method and apparatus can be readily utilized in already existant installations working with various types of detectors which have different response characteristics.

Still another important object of the present invention is directed to a new and improved method of, and apparatus for, signalling an alarm in which human error is precluded as far as possible when the installation is staffed with control personnel.

Now in order to implement these and still further objects of the invention, which will become more readily apparent as the description proceeds, the method of the present development is manifested by the features that, the central signal station resets the detector a second time when the same responds a second time prior to the expiration of the test time period of comparatively shorter duration and an alarm signal is triggered or released in such case when the detector responds a third time after a delay time period which is shorter than the difference between the durations of the two test time periods and prior to the expiration of the test time period of comparatively longer duration, and the central signal station returns into the original state if the detector does not again respond prior to the expiration of the test time period of comparatively longer duration.

As alluded to above, the invention is not only concerned with the aforementioned method aspects, but also relates to a novel construction of apparatus for the performance thereof. Generally speaking, the inventive apparatus comprises a central alarm signal station and at least one detector which is connected therewith and responds to ambient conditions, a reset circuit located in the central alarm signal station for resetting the at least one detector which has responded at least one time, and an evaluating circuit for transmitting alarm signals. This evaluating circuit comprises a timing circuit for generating two predetermined test time periods of different time durations and which transmits an alarm signal when, after a first reset of the detector, such detector responds a second time after expiration of the test time period of comparatively shorter duration and prior to the expiration of the test time period of comparatively longer duration.

To achieve the aforementioned measures, the inventive apparatus for signalling an alarm, in its more specific aspects, comprises:

switching elements in the reset circuit reset a detector, which has responded, a second time, when such detector has responded a second time prior to the expiration of the test time period of comparatively shorter duration. The evaluating circuit transmits an alarm signal when the detector, which has been reset a second time, responds a third time after a predetermined delay time period which is shorter than the difference between the two test time periods and prior to the expiration of the test time period of comparatively longer duration; and a gate circuit in the evaluating circuit blocks the transmission of an alarm signal when no detector response again occurs prior to the expiration of the test time period of comparatively longer duration.

BRIEF DESCRIPTION OF THE DRAWINGS

The invention will be better understood and objects other than those set forth above, will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Describing now the drawings, it is to be understood that only enough of the construction of the apparatus has been shown as needed for those skilled in the art to readily understand the underlying principles and concepts of the present development, while simplifying the showing of the drawings. Turning attention now specifically to FIG. 1, there has been schematically illustrated a block circuit diagram of an apparatus for signalling an alarm and which is constructed as a fire detecting installation. A multiple number of fire alarms or fire detectors D are connected to a central signal station S via a common connecting line system L. The fire detectors D all may be of the same known type, for example, ionization fire detectors or optical smoke detectors, or may be constituted by known detectors which react to other phenomena related to burning or combustion conditions. Preferably the fire detectors D are equipped with a suitable self-holding circuit so that the fire detectors D, following their response and after exceeding a threshold value, for example, of smoke concentration, remain in their alarm or response state until they have possibly been reset. However, there can also be simultaneously connected to the central signal station S fire detectors D of different types, for example, detectors having differently delayed responses, since the different characteristics of such detectors are accounted for by the special design of the central signal station S so that no specific adaptation or matching is required.

Figure 2:
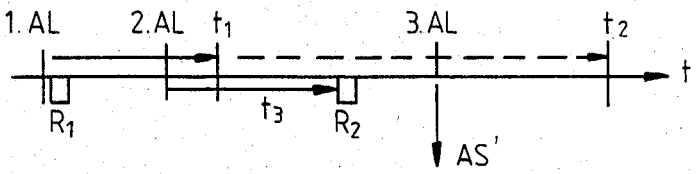
FIG. 2 is a functional diagram with respect to time of the apparatus shown in FIG. 1.

The signals originating at the fire detectors D are supplied to a reset circuit R containing switching elements RS and arranged at the input side of the central signal station S. After their first response 1.AL, the fire detectors D are immediately reset by means of the central signal station S, i.e. by the reset circuit R therein, as shown in the functional diagram with respect to time depicted in FIG. 2. An evaluating or evaluation circuit A is operatively connected to the reset circuit R and is capable of transmitting or initiating transmission of an alarm signal. The detector reset operation is effected, for example, by a short-time lowering of the supply voltage of the fire detectors D as is illustrated by $R_1$ and by techniques well known in this technology. Simultaneously, a timing circuit T in the evaluating circuit A of the central signal station S is started by the reset circuit R. This timing circuit T comprises a time window, that is, it generates, at a predetermined moment of time after the first detector response 1.AL, two test time periods $t_1$ and $t_2$ of predetermined different time durations which, when conventional ionization fire detectors are used, preferably can be selected in the order of magnitude of 20 and 90 seconds, respectively. In the illustrated example, the predetermined moment of time at which the test time periods are started, is immediately after the first detector response 1.AL. There is now tested by means of such timing circuit T at which time after reset of such detector the fire detector D again responds. This second response is indicated in FIG. 2 by the reference character 2.AL. Three cases can be differentiated for such second response 2.AL:

1. The second response 2.AL occurs after expiration of the second test time period $t_2$ of comparatively longer duration, i.e. more than 90 seconds after the first response 1.AL. This is interpreted to mean that no persistent fire phenomenon is present, but only a short-lived or brief irregularly occurring spurious effect like, for example, electric noise pulses or clouds of cigarette smoke. Consequently, the release of the alarm signal is blocked and no alarm is signalled.
2. The second response 2.AL occurs prior to the expiration of the longer second test time period $t_2$, however, after expiration of the first test time period $t_1$ of comparatively shorter duration, i.e. between 20 and 90 seconds after reset. This is interpreted to mean that there is present a more enduring fire or combustion phenomenon, that is a persisting smoke concentration, and that the signal has originated from a fire detector D of longer response time, for example, from an ionization fire detector containing an integration circuit which, anyhow, responds only when the threshold value thereof is exceeded for a more prolonged time and thus, in any case, has enhanced reliability with respect to triggering faulty alarms. It is for this reason that there is therefore immediately activated an alarm signal transmitter AS connected with the evaluating circuit A and an alarm signal AS' transmitted.
3. The second response 2.AL already occurs prior to the expiration of the shorter first test time period $t_1$, i.e. prior to 20 seconds after reset. This is only possible in the case of rapidly responding detectors D. In such case it may be doubtful whether the state or condition of danger is persistent or whether there is only present a more persistent spurious effect. In this case, therefore, the reset circuit R is caused to again reset the fire detector D a second time after a predetermined delay time period $t_3$. There is then tested whether a further response 3.AL occurs within the still running test time period $t_2$ of comparatively longer duration. If such is the case, the alarm signal transmitter AS is instantly activated. When this is not the case, the alarm signal transmission is blocked by means of the gating circuit or gate means G of the evaluating circuit A and the central signal station S is returned into the original state. In order to achieve the effects hereinbefore described, the delay time period $t_3$ must be smaller than the difference $t_2-t_1$, i.e. the difference between the test time period of the predetermined comparatively longer duration $t_2$ and the test time period of the predetermined comparatively shorter duration $t_1$. The delay time period $t_3$ may have a duration of, for example, in the range from 0 to preferably 30 seconds.

Using the method as described hereinbefore for measuring the further response times after detector reset and for classifying the further response time into three time classes, there could be advantageously achieved, according to a practical embodiment of the inventive apparatus using commercially available ionization fire detectors as the fire detectors D, a surprising reduction in the frequency of false alarms during practical operation up to a factor of 5 in comparison to known evaluating methods using reset and response repetition and two-stage classification (YES/NO). Additionally, the inventive apparatus automatically adjusts to the response characteristics of the fire detectors D connected therewith, so that no adaption or matching measures are required.

Figure 1:
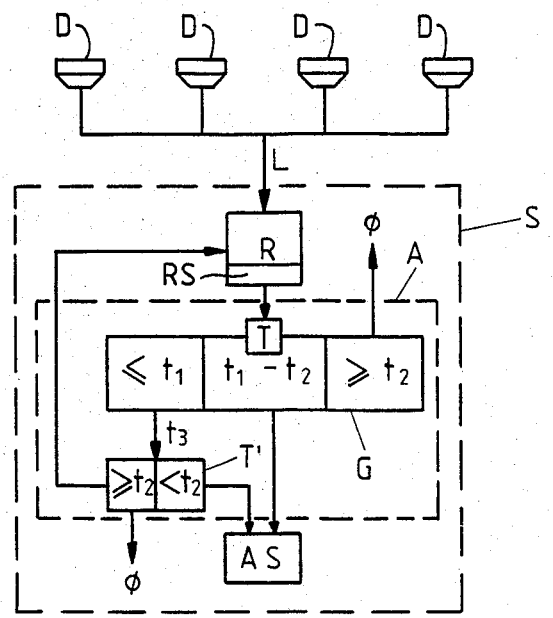
FIG. 1 is a block circuit diagram of an exemplary embodiment of apparatus according to the invention for signalling an alarm.

It will be readily apparent that the aforedescribed principles are applicable to individual fire detectors or fire detectors connected together into detector groups, as for instance shown in FIG. 1.

Modifications and further developments are possible within the scope and teachings of the inventive concepts. Thus, it can be advantageous to connect a repetition stage in such a manner as to precede the steps of the inventive method, so that the start of the test time periods $t_1$, $t_2$ is only released when a fire detector D has responded a second time after a first response and the consecutive detector reset. It may be preferable to employ a number of such repetitions.

The inventive method has been described hereinbefore with reference to a fully automatically operating apparatus.

Figure 3:
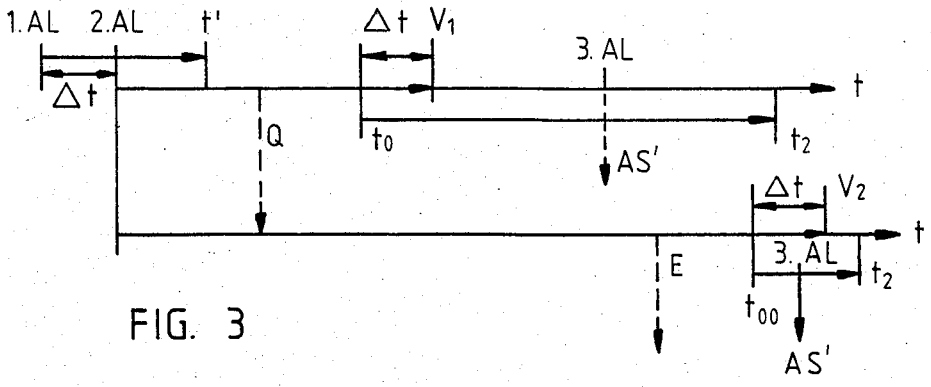
FIG. 3 is a functional diagram with respect to time of a further embodiment of apparatus according to the invention used in combination with control personnel.

However, it may also be preferable and advantageous to use the inventive concepts with respect to an apparatus for signalling an alarm, for example, a fire detecting installation which at least partially is monitored by control personnel, for example, during the daytime by employing a suitable daytime-circuit. FIG. 3 shows a time diagram of such apparatus. After a first response 1.AL of a fire detector D the related detector group i.e. the responding detector of the group is reset and the time period $\Delta t$ is determined until the next-following response 2.AL. When this time period $\Delta t$ is greater than a predetermined time limit t', the second response 2.AL is assessed as a new event and the entire cycle is restarted. In the other case, i.e. with a shorter further response time $\Delta t$, as shown in FIG. 3, there are started at the second response 2.AL a control time period $V_1$ which, for example, may last two minutes, and simultaneously therewith a reconnaissance time $V_2$ of, for example, ten minutes. The control time period $V_1$ can be interrupted by an acknowledgement or receipt signal Q signalling the attention of the control personnel and the reconnaissance time $V_2$ can be interrupted by a reset signal E which is released or triggered by the dispatched reconnaissance party or by a manually released or triggered alarm signal. When these manual interruptions fail to appear, the group of detectors D is once again automatically reset at a moment of time $\Delta t$ prior to the expiration of the control time period $V_1$ or, respectively, of the reconnaissance time $V_2$ and the test time periods $t_1$ and $t_2$ begin to start at such moments of time $t_0$ or, respectively, $t_{00}$. The moment of time at which the test time periods are started, is shortly prior to the expiration of the control time period $V_1$ and of the reconnaissance time period $V_2$ by a differential time $\Delta t$ which is defined by the time difference between the second response 2.AL and the first response 1.AL or by the time difference between the first response 1.AL and a further response preceding the same. At the occurrence of a further response, that is a third response within the test time period $t_2$ there is then immediately released or triggered an alarm signal AS'. In such arrangement the test time period $t_1$ can be set equal to 0.

It is also possible that the aforementioned steps are only initiated after one or more response-reset cycles of the fire detector D. The arrangement may also be such that the acknowledgement signal or the reconnaissance signal blocks the start of the first and second test time periods.

In this manner there is achieved the result that even in the case of human failure there is ensured a reliable release or triggering of an alarm signal AS' with the least possible frequency of false alarms.

While there are shown and described present preferred embodiments of the invention, it is to be distinctly understood that the invention is not limited thereto, but may be otherwise variously embodied and practiced within the scope of the following claims. ACCORDINGLY,

What we claim is:

1. A method of signalling an alarm using at least one resettable detector connected to a central signal station, said method comprising the steps of:

resetting the at least one detector a first time by means of the central signal station after a first detector response;

starting, by means of said central signal station at a predetermined moment of time after said first detector response, a first test time period and a second test time period of predetermined different durations;

selecting said first test time period of a predetermined comparatively shorter duration and said second test time period of a predetermined comparatively longer duration;

at the occurrence of a second detector response after the expiration of said first test time period of the predetermined comparatively shorter duration and prior to the expiration of said second test time period of the predetermined comparatively longer duration, transmitting an alarm signal;

at the occurrence of said second detector response prior to the expiration of said first test time period of the comparatively shorter duration, starting a delay time period of a predetermined duration which is shorter than the difference between the predetermined durations of said first test time period and said second test time period;

resetting said at least one detector a second time after expiration of said delay time period;

transmitting an alarm signal at the occurrence of a third detector response after said delay time period and prior to the expiration of said second test time period of the predetermined comparatively longer duration; and returning the central signal station to a predetermined original state when said third detector response does not occur prior to the expiration of said second test time period of comparatively longer duration.

2. The method as defined in claim 1, further including the steps of:

the step of selecting said first test time period and said second test time period entails selecting the first test time period of said predetermined comparatively shorter duration in the order of magnitude of about 20 seconds and the second test time period of said predetermined comparatively longer duration in the order of magnitude of about 90 seconds; and the step of starting said delay time period includes the step of selecting said delay time period of a duration in the order of magnitude of about 30 seconds or less.

3. The method as defined in claim 1, wherein:

the step of starting, by means of said central signal station at a predetermined moment of time after said first detector response, the first test time period and the second test time period entails the step of starting said first and said second test time periods immediately after said first detector response.

4. The method as defined in claim 1, wherein:

the step of starting, by means of said central signal station at a predetermined moment of time after said first detector response, said first and said second test time periods entails the step of substantially simultaneously starting said first and said second test time periods.

5. The method as defined in claim 1, wherein:

said step of starting, by means of said central signal station at a predetermined moment of time after said first detector response, the first test time period and the second test time period entails the step of starting said first and said second test time periods only after at least one further detector response after said resetting of said at least one detector said first time.

6. The method as defined in claim 1, further including the steps of:

starting, after said first detector response, a control time period of a predetermined duration;

generating, within said control time period, an acknowledgement signal which blocks the starting of said first and said second test time periods; and the step of starting, by means of said central signal station at a predetermined moment of time after said first detector response, the first test time period and the second test time period entails starting said first and said second test time periods shortly before expiration of said control time period of predetermined duration provided that said starting of said first and said second test time periods is not blocked by said acknowledgement signal.

7. The method as defined in claim 6, further including the steps of:

starting, after said first detector response and substantially and simultaneously with said control time period, a predetermined reconnaissance time period of a predetermined duration which is greater than said predetermined duration of said control time period;

generating, within said reconnaissance time period, a reconnaissance signal which blocks the starting of said first and said second test time periods; and in the step of starting, by means of said central signal station at a predetermined moment of time after said first detector response, the first test time period and the second test time period entails starting said first and said second test time periods shortly before expiration of said reconnaissance time period of predetermined duration provided that said starting of said first and said second test time periods is not blocked by said reconnaissance signal.

8. The method as defined in claim 7, wherein:

the step of starting said control time period includes the step of starting said control time period only after at least one further response and at least one further reset of the detector.

9. The method as defined in claim 8, wherein:

the step of starting said first test time period and said second test time period entails the step of delaying said starting of said first and said second test time periods shortly before expiration of said control time period of predetermined duration and of said reconnaissance time of predetermined duration by a differential time defined by the time difference between said first detector response and said at least one further detector response.

10. The method as defined in claim 9, further including the step of:

selecting, as said first test time period, a first test time period of zero duration.

11. The method as defined in claim 1, further including the steps of:

starting, after said first detector response, a control time period of a predetermined duration;

generating, within said control time period, an acknowledgement signal which blocks the run of said first and said second test time periods; and the step of starting, by means of said central signal station at a predetermined moment of time after said first detector response, the first test time period and the second test time period entails starting said first and said second test time periods shortly before expiration of said control time period of predetermined duration provided that said run of said first and said second test time periods is not blocked by said acknowledgement signal.

12. The method as defined in claim 11, further including the steps of:

starting, after said first detector response and substantially simultaneously with said control time period, a predetermined reconnaissance time period of a predetermined duration which is greater than said predetermined duration of said control time period;

generating, within said reconnaissance time period, a reconnaissance signal which blocks the run of said first and said second test time periods; and the step of starting, by means of said central signal station at a predetermined moment of time after said first detector response, the first test time period and the second test time period entails starting said first and said second test time periods shortly before expiration of said reconnaissance time period of predetermined duration provided that said run of said first and said second test time periods is not blocked by said reconnaissance signal.

13. The method as defined in claim 12, wherein:

the step of starting said control time period and said reconnaissance time period includes the step of starting said control time period and said reconnaissance time period only after at least one further response and at least one further reset of the at least one detector.

14. The method as defined in claim 13, wherein:

the step of starting said first test time period and said second test time period entails the step of delaying said starting of said first and said second test time periods shortly before expiration of said control time period of predetermined duration and of said reconnaissance time period of predetermined duration by a differential time defined by the time difference between said first detector response and said at least one further detector response.

15. The method as defined in claim 14, further including the step of:

selecting, as said first test time period, a first test time period of zero duration.

16. An apparatus for signalling an alarm, comprising:

a central alarm signal station;

at least one detector operatively connected to said central alarm signal station and responding to ambient conditions of such detector;

a reset circuit located in said central alarm signal station and operatively connected to said at least one detector in order to reset the same after the detector has responded at least once;

an evaluating circuit operatively connected to said reset circuit and capable of initiating transmission of an alarm signal;

said evaluating circuit containing a timing circuit for generating a first test time period of predetermined comparatively shorter duration and a second test time period of predetermined comparatively longer duration;

said evaluating circuit being operatively connected with said reset circuit in such a manner that there is produced, after a first response of said detector, a first reset of said detector and said evaluating circuit initiating transmission of said alarm signal at the occurrence of a second response of said detector after the expiration of said first test time period of comparatively shorter duration and prior to the expiration of said second test time period of comparatively longer duration;

said evaluating circuit further being operatively connected with said reset circuit in such a manner that there is produced, after said first reset and said second response of said detector, a second reset of said detector upon the occurrence of said second response of the detector prior to the expiration of said first time period of comparatively shorter duration, and said evaluating circuit further initiating transmission of said alarm signal at the occurrence of a third response of said detector prior to the expiration of said second test time period of comparatively longer duration and prior to a predetermined delay time period which is shorter than the time difference between the second test time period of comparatively longer duration and the first test time period of comparatively shorter duration; and said evaluating circuit further containing a gate circuit blocking the transmission of said alarm signal when no third response of said detector occurs prior to the expiration of said second test time period of comparatively longer duration.

17. The apparatus as defined in claim 15, wherein:

said at least one detector constitutes at least one fire detector responsive to combustion phenomena.

18. The apparatus as defined in claim 16, wherein:

said reset circuit contains switching elements.

* * * * *

UNITED STATES PATENT AND TRADEMARK OFFICE

CERTIFICATE OF CORRECTION

PATENT NO. : 4,568,924

DATED : February 4, 1986

INVENTOR(S) : Alfred Wüthrich et al

It is certified that error appears in the above—identified patent and that said Letters Patent is hereby corrected as shown below:

Column 10, line 61, (claim 17, line 1) please change "15" to read --16--

Signed and Sealed this

Fourth Day of November, 1986

[SEAL]

*Attest:*

DONALD J. QUIGG

*Attesting Officer*

*Commissioner of Patents and Trademarks*